United States Patent [19]

Lakdawala

[11] 4,280,334

[45] Jul. 28, 1981

[54] WATER CONDENSATE RECOVERY DEVICE

[76] Inventor: Ness R. Lakdawala, 119 de Touraine St., St. Lambert, Quebec, Canada

[21] Appl. No.: 52,253

[22] Filed: Jun. 26, 1979

[51] Int. Cl.[3] ..... F25B 47/00

[52] U.S. Cl. ..... 62/277; 62/150; 62/225; 62/507

[58] Field of Search ..... 62/150, 225, 247, 238 E, 62/279, 280, 277, 507

[56] References Cited

U.S. PATENT DOCUMENTS

| | | | |
|---|---|---|---|
| 2,679,144 | 5/1954 | Grimshaw et al. | 62/279 |
| 2,923,136 | 2/1960 | Tiede | 62/225 |

FOREIGN PATENT DOCUMENTS

| | | | |
|---|---|---|---|
| 218380 | 8/1957 | Australia | 62/280 |

*Primary Examiner*—Albert J. Makay

*Assistant Examiner*—Henry Bennett

*Attorney, Agent, or Firm*—Swabey, Mitchell, Houle, Marcoux & Sher

[57] ABSTRACT

A water condensate recovery device for use in a refrigeration system. The device comprises a condensate compartment for receiving condensate water therein. A heat transfer conduit is provided in the condensate compartment through which refrigerant fluid from a compressor flows for cooling therein by the condensate water. Aperture means is provided with the condensate compartment to permit escape of vapor caused by evaporation of condensate water therein during heat transfer between the refrigerant fluid in the heat transfer conduit and the condensate water. The condensate compartment permits disposal of the condensate water by evaporation and simultaneously reduces the discharge pressure of the compressor by cooling the refrigerant fluid from the compressor.

6 Claims, 2 Drawing Figures

WATER CONDENSATE RECOVERY DEVICE

BACKGROUND OF THE INVENTION

1. Field of Invention

The present invention relates to a water condensate recovery device for use in a refrigeration system to utilize condensate water to further cool the refrigerant fluid in the system, to evaporate the condensate water and in the process conserve energy by reducing the energy consumption of the compressor.

2. Description of Prior Art

Refrigeration systems are known where condensate water is disposed of by either drainage of the water into a collector pan or other means, or either by evaporation.

This invention relates to a device which will evaporate condensate water but in the process utilizes the condensate water in conjunction with other parts of the refrigeration system to cool the refrigerant fluid at the output of the compressor and achieve a conservation of energy in the system.

SUMMARY OF THE INVENTION

It is therefore a feature of the system of this invention to provide a water condensate recovery device for use in a refrigeration system whereby to use the condensate water to cool the refrigerant fluid from a compressor and simultaneously cause evaporation of the water.

A further feature of the invention is to provide additional cooling of the refrigerant fluid in the recovery device by immersing a refrigerant fluid line, from a cooling condensor of the system, into the device in contact with condensate water therein.

A still further feature of the invention is to provide a novel method of disposing of condensate water in a refrigeration system and cooling refrigerant fluid from a compressor in such system thereby lowering the energy used by the compressor by lowering the pressure and temperature of the refrigerant gas at the outlet of the compressor.

A still further feature of the invention is to provide a water recovery device which is compact, economical to construct and easily adaptable to refrigeration systems.

According to the above features, from a broad aspect, the present invention provides a water condensate recovery device for use in a refrigeration system. The device comprises a condensate housing for receiving condensate water therein. The housing has side walls, a bottom wall and a top wall. A compressor heat transfer conduit is disposed parallel and adjacent the bottom wall for contact with the condensate water and through which refrigerant fluid from the compressor flows for cooling therein by the condensate water. The compressor heat transfer conduit also is connected to an input line of a refrigerant cooling condensor. The condensor has an output line connected to a refrigerant fluid conduit disposed parallel to the bottom wall of the housing for contact with condensate water in the housing to provide cooling of the refrigerant fluid from the condensor. Aperture means is provided in the condensate housing to permit escape of vapour caused by evaporation of the condensate water therein during heat transfer between the refrigerant fluid in the compressor heat transfer conduit and the refrigerant fluid conduit. The condensate cooling in the housing further permits simultaneous reduction of the discharge pressure of the compressor.

BRIEF DESCRIPTION OF THE DRAWINGS

A preferred embodiment of the present invention will now be described with reference to the example thereof illustrated by the accompanying drawings in which.

DESCRIPTION OF PREFERRED EMBODIMENT

Figure 1:
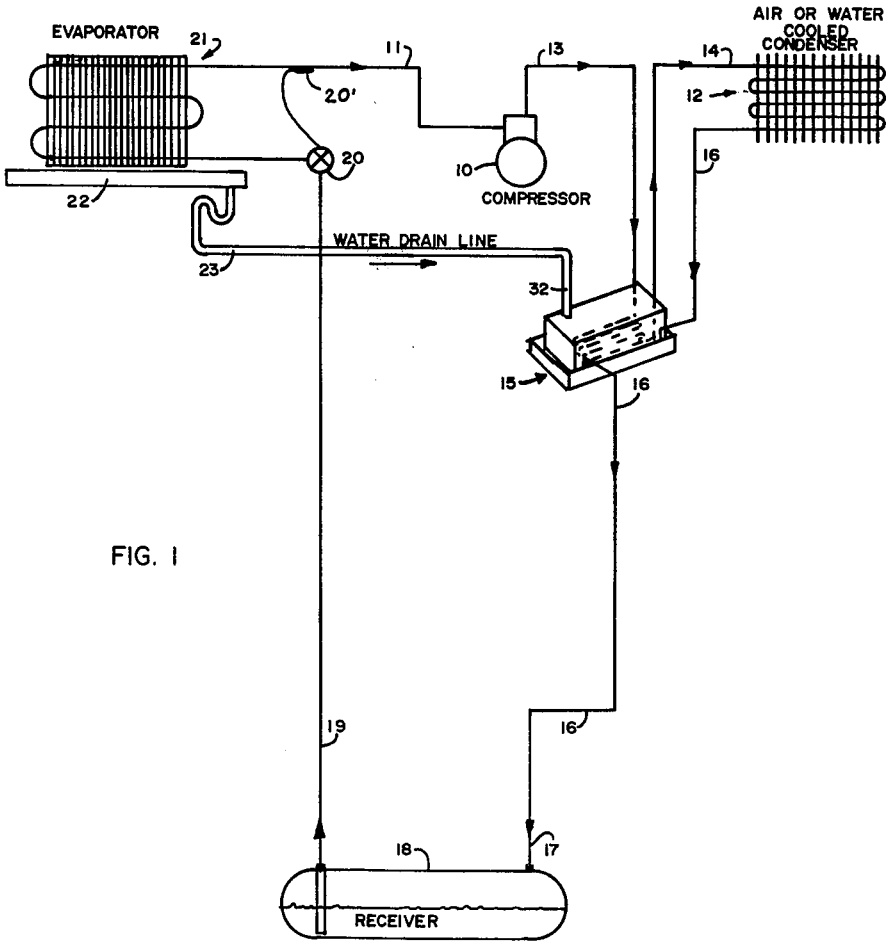
FIG. 1 is a schematic flow diagram of a conventional refrigeration system utilizing the water condensate recovery device of the present invention.

Referring now to the drawings and more particularly to FIG. 1, there is shown a conventional refrigeration system consisting of a compressor device 10 feeding a refrigerant fluid which is present in the input feed line 11 to a cooling condenser 12. Usually, in a conventional refrigeration system, the output feed line 13 of the compressor 10 is fed directly to the input feed line 14 of the condenser 12. However, the water-condensate recovery device 15 of the present invention is connected in the circuit at this juncture between the compressor 10 and the condenser 12 to cool the refrigerant fluid at the output of the compressor 10 to thereby lower the temperature thereof and consequently achieve a drop in pressure causing the compressor to consume less current.

Conventionally, the output feed line 16 of the condenser 12 is usually fed to the intake line 17 of a receiver 18. The discharge line 19 of the receiver 18 is connected to an expansion valve 20 (or similar capillary device) associated with an evaporator 21 to achieve the cooling effect of the refrigerant liquid as it evaporates. A sensor device 20' is connected to the valve 20 and senses the temperature at the output line 11 for controlled operation. The output feed line 11 of the evaporator feeds the compressor 10 which in turn feeds the condensor to complete the cycle. The evaporator 21 is provided with a condensate recovery trap 22 provided with a drain line 23 through which condensate water flows for the disposal thereof. This refrigeration system arrangement achieves the thermodynamic cycle of the refrigerant to obtain cooling of air or liquids.

Figure 2:
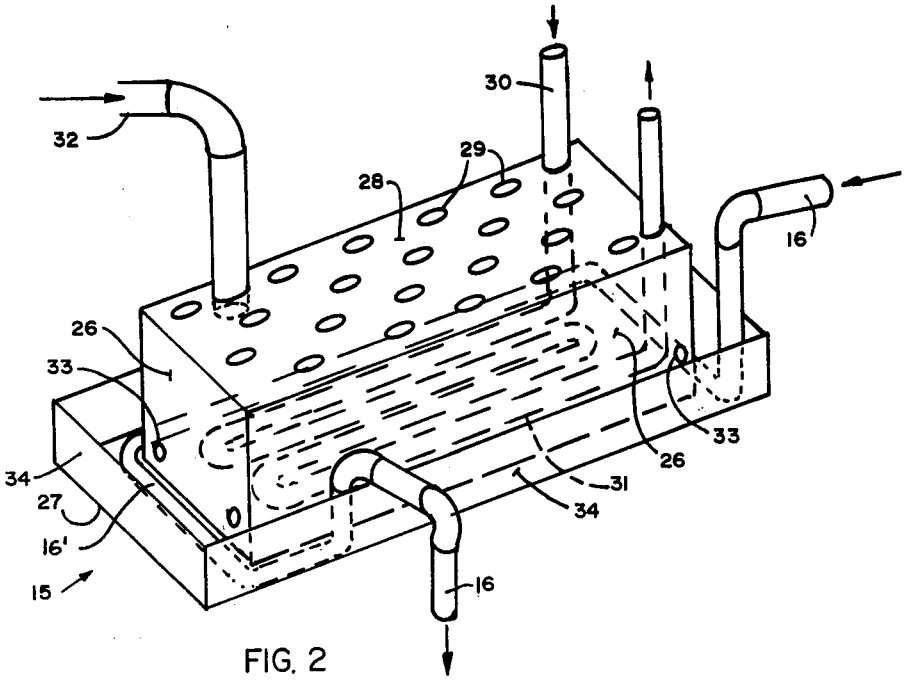
FIG. 2 is a perspective fragmented view showing the construction of the water condensate recovery device.

Referring now to FIG. 2, there is shown the construction of the water condensate recovery device 15 of this invention and it comprises a condensate compartment 25 constituted by a housing having side walls 26, a bottom wall 27 and a top wall 28. Aperture means in the form of one or more holes or apertures 29 are provided in one of the side walls or top wall, here in the top wall 28, to permit escape of vapour from within the condensate compartment 25.

A heat transfer conduit 30 is provided with a coiled section 31, having a plurality of convolutions disposed within the condensate compartment 25 in the lower part thereof whereby it will be immersed in condensate water flowing thereinto through the drain line inlet connection 32. The side walls 26 are provided with overflow apertures 33 to direct condensate water from within the condensate compartment into an outer trough 34 completely surrounding the side walls 26 of the compartment 25 and formed integral with the bottom wall 27 of the condensate compartment 25, thus constituting a channel completely surrounding the side walls 26. This channel acts as a reservoir to provide further cooling.

The output feed line 16 of the condenser 12 contains cooled refrigerant fluid, now in liquid state as the gas refrigerant fed at the inlet feed line is cooled down, and this line is disposed along a suitable path 16' in the trough 34 surrounding the side walls 26 whereby the cooled refrigerant therein is further cooled by the condensate water within the compartment 25. As shown, the path 16' of the output feed line 16 extends along a major portion of the trough 34 where condensate water is supplied from the compartment 25 via the apertures 33. This provides further cooling of the refrigerant thereby to provide better cooling of the refrigerant fluid in the line 16 before feeding it to the evaporator device 20. The further cooling of the refrigerant fluid in the conduit 30, at the output of the compressor which is in a gaseous state, permits lowering of the discharge pressure of the compressor thereby resulting in a reduction in the current consumption of the compressor. As the refrigerant fluid is cooled in the coiled section 31 of the transfer conduit 30 there is heat exchange between the hot refrigerant fluid in the coil section 31 and the condensate water causing evaporation of condensate water. Thus, the condensate recovery device 15 also constitutes an island evaporator device for the refrigeration system whereby the condensate water is disposed of.

Referring again to FIG. 1, it can thus be seen that the condensate water recovery device 15 of the present invention, when utilized in a refrigeration system such as the conventional one shown in this Figure, achieves a dual purpose and namely of further cooling the condensate fluid at the output of the compressor 10, before feeding it to the condenser 12, whereby to reduce the energy requirement of the system and further, in the process of cooling the refrigeration fluid, utilizes such refrigerant fluid to cause evaporation of condensate water recovered from the evaporator 21 without the use of special evaporator devices driven by other means. Therefore, the condensate recovery device 15 provides a method of disposing condensate water in a refrigeration system and simultaneously cooling discharged refrigerant fluid from the compressor of that system.

The construction of the water condensate recovery device 15 further provides additional cooling of the refrigerant fluid by directing the refrigerant fluid from the cooling condenser 12 in the system through a further conduit section 16' which passes through the condensate compartment 25 and a trough 34 disposed thereabout.

It is within the ambit of the present invention to provide various modifications of the condensate water recovery device provided such modifications fall within the scope of the attached claims. For example, the condensate compartment may be an open-ended tube with the coil section 31 disposed in the tube. Also, the condensate water would be fed into the tube. Further, the coil section 31 may be welded to the side walls 26 of the compartment 25 for better heat transfer or disposed otherwise within the compartment.

I claim:

1. A water condensate recovery device for use in a refrigeration system, said device comprising a condensate housing for receiving condensate water therein; said housing having side walls, a bottom wall and a top wall; a compressor heat transfer conduit disposed parallel and adjacent said bottom wall for contact with said condensate water and through which refrigerant fluid from a compressor flows for cooling therein by said condensate water, said compressor heat transfer conduit also being connected to an input line of a refrigerant cooling condensor, said condensor having an output line connected to a refrigerant fluid conduit disposed parallel to said bottom wall of said housing for contact with said condensate water of said condensate housing to provide cooling of said refrigerant fluid from said condenser, and aperture means in said condensate housing to permit escape of vapour caused by evaporation of the condensate water therein during heat transfer between said refrigerant fluid in said compressor heat transfer conduit and said refrigerant fluid conduit, said condensate cooling in said housing further permitting simultaneous reduction of the discharge pressure of said compressor.

2. A device as claimed in claim 1, wherein said condensate housing is provided with an outer trough to receive overflow condensate water from said housing, said housing having overflow apertures in at least one side wall thereof to permit condensate water flow from said housing to said outer trough.

3. A device as claimed in claim 2, wherein said aperture means are one or more apertures in at least one of said walls to permit escape of said vapour from said housing.

4. A device as claimed in claim 3, wherein said outer trough is a channel completely surrounding said housing, said refrigerant fluid conduit being disposed partly through said channel and said housing for contact with condensate water therein.

5. A device as claimed in claim 1, wherein said heat transfer conduit is a coiled shape conduit having a plurality of convolutions and disposed in said condensate housing for immersion in said condensate water therein.

6. In a refrigeration system having a compressor feeding a refrigerant fluid to a cooling condenser, a receiver having an input fed by said condenser, said receiver being connected at an output to an expansion valve to feed said refrigerant fluid to an evaporator which supplies said compressor, said evaporator producing condensate water, the improvement comprising a water condensate recovery device having a condensate housing for receiving said condensate water; said housing having side walls, a bottom wall and a top wall; a compressor heat transfer conduit disposed parallel and adjacent said bottom wall for contact with said condensate water and through which refrigerant fluid from said compressor is circulated for cooling same by said condensate water, said compressor heat transfer conduit also being connected to an input line of a refrigerant cooling condensor, said condensor having an output line connected to a refrigerant fluid conduit disposed parallel to said bottom wall for contact with said condensate water in said condensate housing to provide cooling of said refrigerant fluid from said condenser, said condensate housing having aperture means to permit escape of vapour caused by evaporation of condensate water therein during heat transfer between said refrigerant in said compressor heat transfer conduit and said refrigerant fluid conduit and said condensate water, said condensate cooling in said housing further permitting simultaneous reduction of the discharge pressure of said compressor.

* * * * *